US007257852B2

(12) United States Patent
Shibuya et al.

(10) Patent No.: US 7,257,852 B2
(45) Date of Patent: Aug. 21, 2007

(54) SUCTION UNIT FOR USE IN AN ELECTRIC VACUUM CLEANER AND ELECTRIC VACUUM CLEANER EMPLOYING SAME

(75) Inventors: Masaki Shibuya, Matsusaka (JP); Koichi Fujita, Yokaichi (JP); Masakuni Soejima, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 521 days.

(21) Appl. No.: 10/847,910

(22) Filed: May 19, 2004

(65) Prior Publication Data

US 2004/0261217 A1 Dec. 30, 2004

(30) Foreign Application Priority Data

May 19, 2003 (JP) ..... 2003-140160

(51) Int. Cl.
*A47L 13/40* (2006.01)

(52) U.S. Cl. ..... 15/1.51; 15/331; 15/415.1

(58) Field of Classification Search ..... 15/377, 15/328, 1.51, 415.1, 416, 419, 331; *A47L 5/36*
See application file for complete search history.

(56) References Cited

U.S. PATENT DOCUMENTS 6,199,244 B1 3/2001 Hilgers et al.
6,519,810 B2 2/2003 Kim
7,131,164 B2 * 11/2006 Uratani et al. ..... 15/328

FOREIGN PATENT DOCUMENTS

JP 2001-338744 12/2001

* cited by examiner

*Primary Examiner*—Theresa T. Snider
(74) *Attorney, Agent, or Firm*—Bacon & Thomas, PLLC

(57) ABSTRACT

A suction unit for use in an electric vacuum cleaner and an electric vacuum cleaner includes a floor nozzle and a mini nozzle detachably secured to the floor nozzle. When a suction head of the mini nozzle is secured to the floor nozzle, an air communication is provided therebetween. Further, the mini nozzle is provided with an ion generating unit.

9 Claims, 10 Drawing Sheets

SUCTION UNIT FOR USE IN AN ELECTRIC VACUUM CLEANER AND ELECTRIC VACUUM CLEANER EMPLOYING SAME

FIELD OF THE INVENTION

The present invention relates to a suction unit for use in electric vacuum cleaners for sucking in dirt particles and an electric vacuum cleaner using same.

BACKGROUND OF THE INVENTION

In conventional negative ion generating devices, negative ions are generated by applying a high voltage generated by a high voltage circuit to separated electrodes, and as a result generating electric discharge via an air pocket interposed therebetween; by emitting electrons of negative charges in the air through electric discharge at a surface of insulator between electrodes which in turn negatively charges water vapors and etc. in the air; or by irradiating surfaces of gold or platinum with ultraviolet ray to emit electrons in the metal to the air which in turn negatively charges the water vapors and etc. in the air. (see, for example, Japanese Patent Laid-open No. 2001-338744)

However, conventional negative ion generating devices employing electric discharge have drawbacks while generating negative ions such as generation of byproducts such as harmful ozone and a high voltage circuit for generating electric discharge employed therein poses a danger of electrocution and a fire. Moreover, in a case of ultra violet ray irradiation method, one has to exercise extra caution to avoid irradiation of harm ultra violet ray on oneself, e.g., the eyes.

SUMMARY OF THE INVENTION

It is, therefore, an object of the present invention to provide a safe and simple electric vacuum cleaner capable of continuously providing large quantities of negative ions to enhance dust collection and improve usability thereof.

In accordance with a preferred embodiment of the present invention, there is provided a suction unit for use in an electric vacuum cleaner including a floor nozzle and a mini nozzle detachably secured to the floor nozzle, wherein when a suction head of the mini nozzle is secured to the floor nozzle, an -air communication is provided therebetween, and wherein the mini nozzle includes an ion generating unit.

In accordance with another preferred embodiment of the present invention, there is provided an electric vacuum cleaner including the suction unit as described above.

BRIEF DESCRIPTION OF THE DRAWINGS

The above and other objects and features of the present invention will become apparent from the following description of preferred embodiments given in conjunction with the accompanying drawings in which.

DETAILED DESCRIPTION OF THE PREFERRED EMBODIMENTS

Preferred embodiments of the present invention will now be described in detail with reference to the accompanying drawings.

Embodiment I

Hereinafter, a first embodiment of the present invention will now be described in detail with reference to FIGS. 1 to 9.

Figure 1:
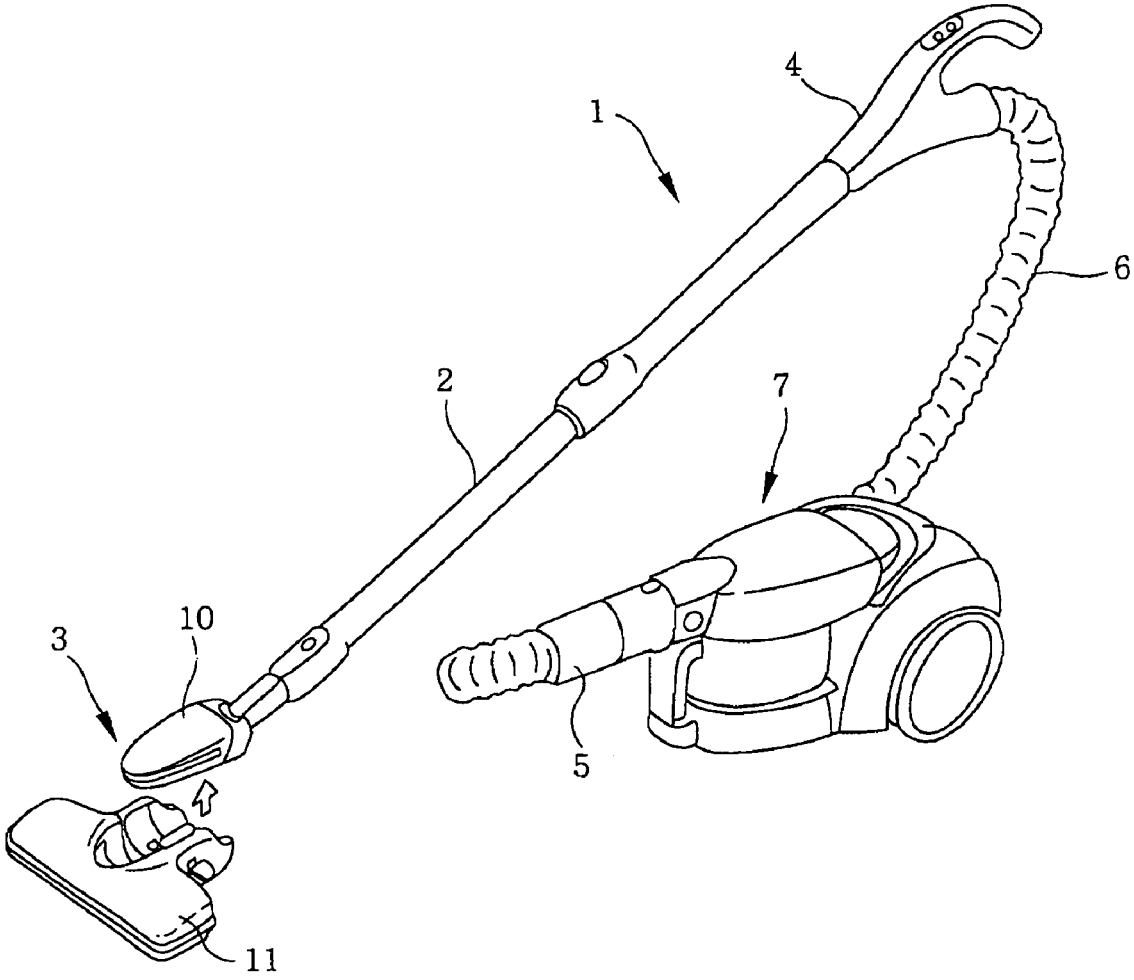
FIG. 1 presents a perspective view of an electric vacuum cleaner having a suction unit for use in electric vacuum cleaners in accordance with a first embodiment of the present invention.

As illustrated in FIG. 1, the preferred embodiment pertains to a canister type electric vacuum cleaner 1 and a suction unit 3 serving as a suction inlet. The suction unit 3 is detachable provided at a distal end portion of an extension tube 2 that is coupled with a handle (control unit) 4. Hose 6 coupled with handle 4 is connected to the main body 7 of the electric vacuum cleaner 1 via hose joint 5.

Figure 2A:
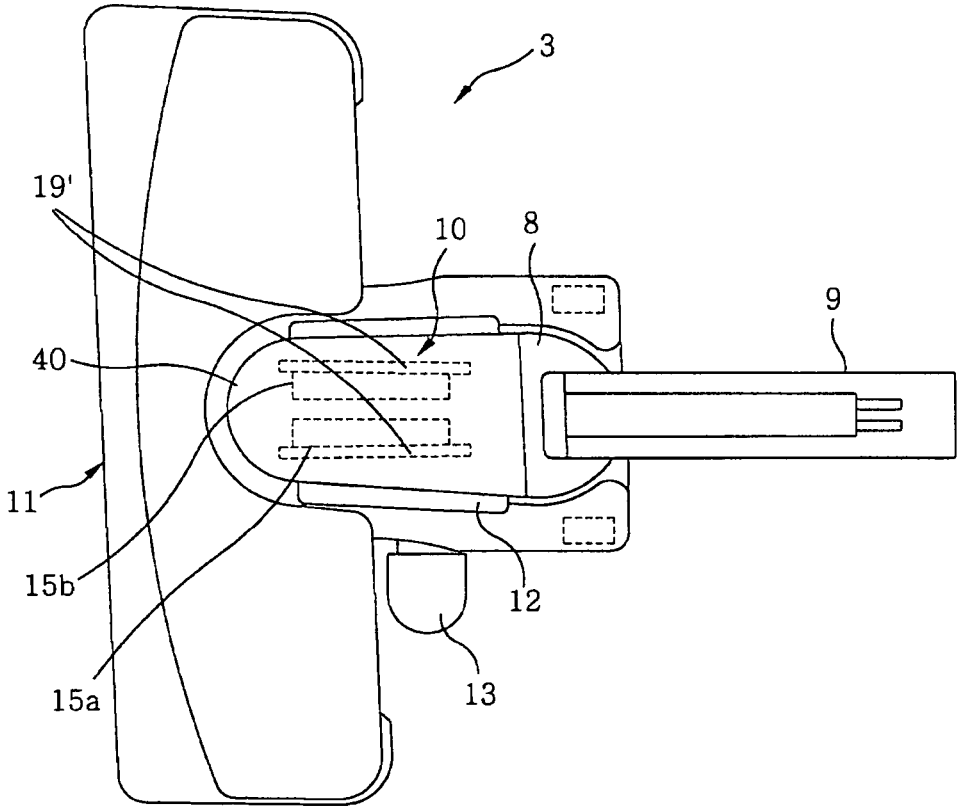
FIGS. 2A and 2B are a plan view and a side elevational view of the suction unit shown in FIG. 1, respectively.
Figure 2B:
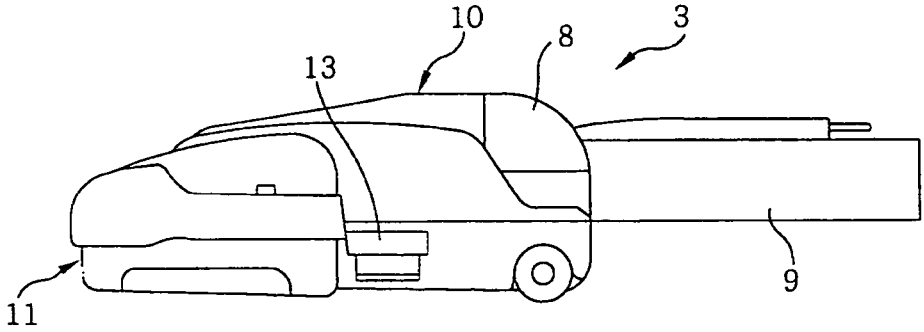

Suction unit 3 as illustrated in FIGS. 2A and 2B, includes floor nozzle 11 and mini nozzle 10 to be detachably secured onto floor nozzle 11. Mini nozzle 10 incorporates connection tube (connection portion) 9 to be connected with extension tube 2; and rotatable joint 8 (means for rotatable jointing) which at a front portion thereof is rotatably connected with suction head 40 of mini nozzle 10 and at a rear portion thereof is connected with connection tube 9 enabling a slanted vertical movement.

Mini nozzle 10 can be disengaged from floor nozzle 11 by stepping on release lever 13 provided thereon, which releases mini nozzle 10 from support 12. A user can utilize disengaged mini nozzle 10 to clean narrow spaces. Moreover, mini nozzle 10 can be placed on support 12 and gently pressed to be engaged with floor nozzle 11, which enables floor nozzle 11 to be used to efficiently carry out vacuuming of a surface to be cleaned.

Figure 3:
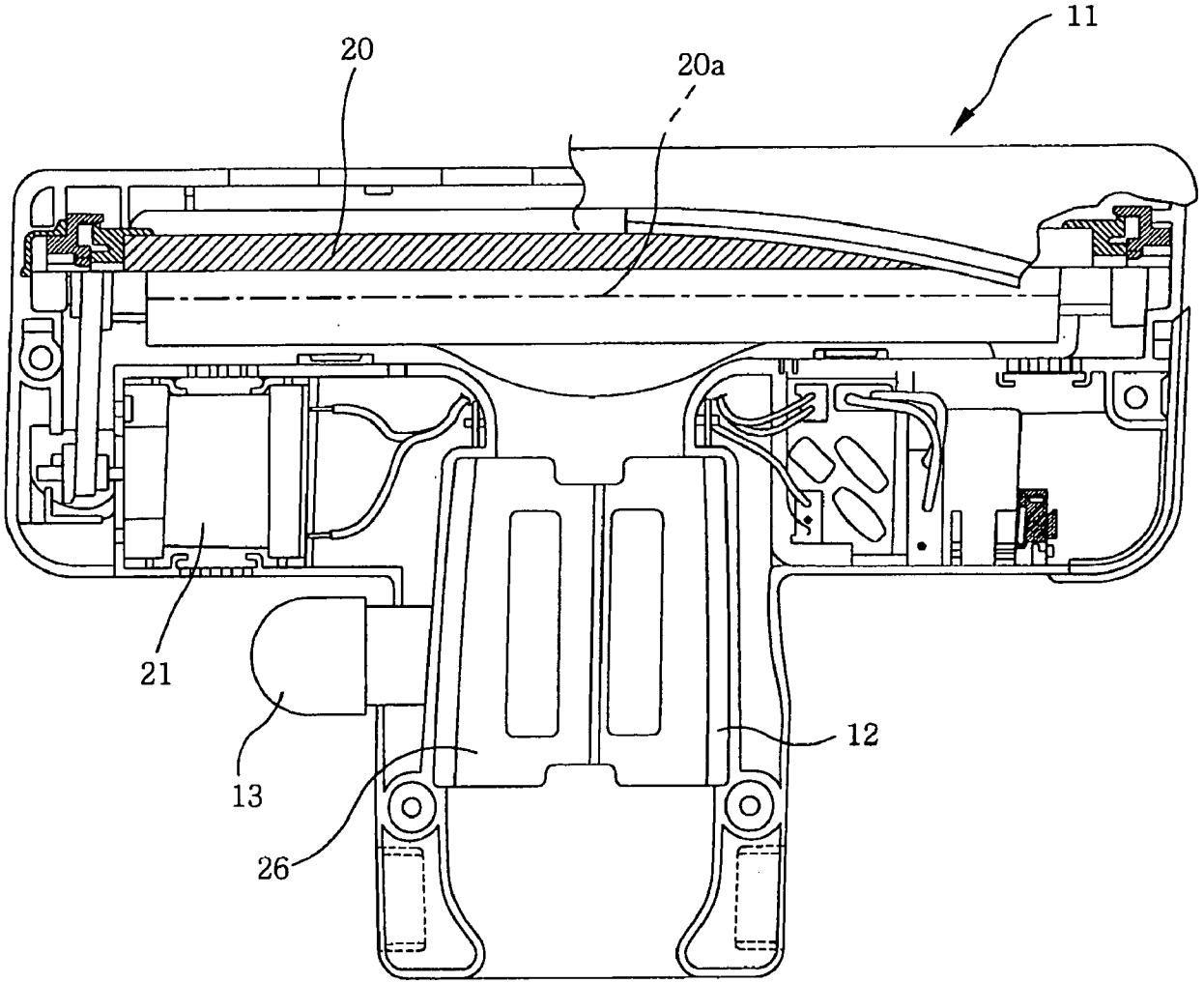
FIG. 3 represents a plan view of an inner configuration of the suction unit shown in FIG. 1.
Figure 4:
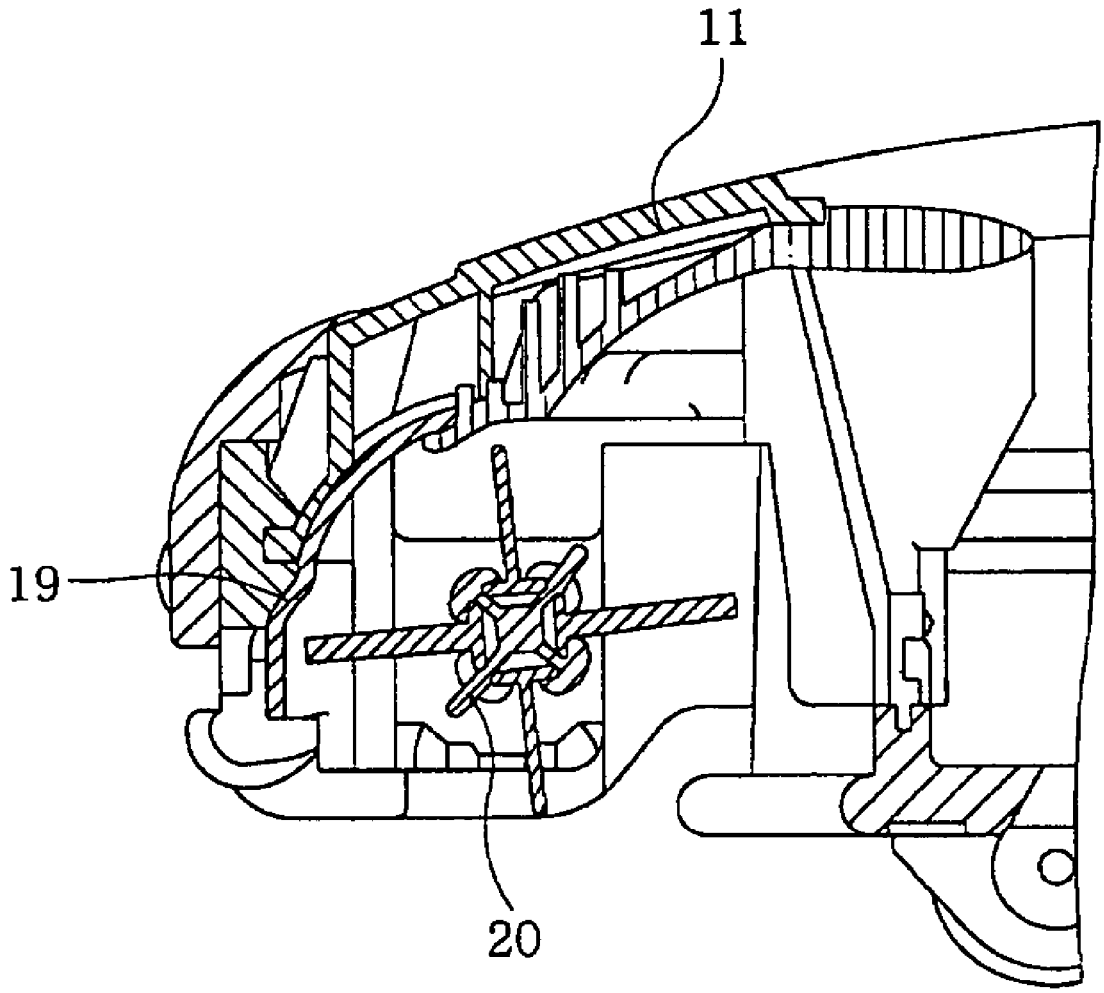
FIG. 4 sets forth a side cross sectional view of a main portion of the suction unit shown in FIG. 1.

Floor nozzle 11 as illustrated in FIG. 3 is of a power nozzle. Rotation brush 20 including a brush (not shown) and a rubber blade (not shown) provided on rotation shaft 20*a* is rotated by motor 21, to collect dirt from, e.g., carpets. Moreover, as shown in FIG. 4, ion generator 19 is installed on an inner wall of a front portion of floor nozzle 11. Ion generator 19 is made of material that has a relatively greater positive charge affinity, e.g., fluoride resin [TEFLON (a trade mark)], vinyl chloride, or the like, according to triboelectric series table relatively ranking charge affinity of various materials. On the other hand, the brush portion of rotation brush 20 is preferably made of material that has a relatively greater positive charge affinity, such nylon, wool, or the like, according to triboelectric series table.

A mechanism of engagement and disengagement of mini nozzle 10 with/from floor nozzle 11 will hereinafter be explained with reference to FIGS. 5 and 6.

Figure 5:
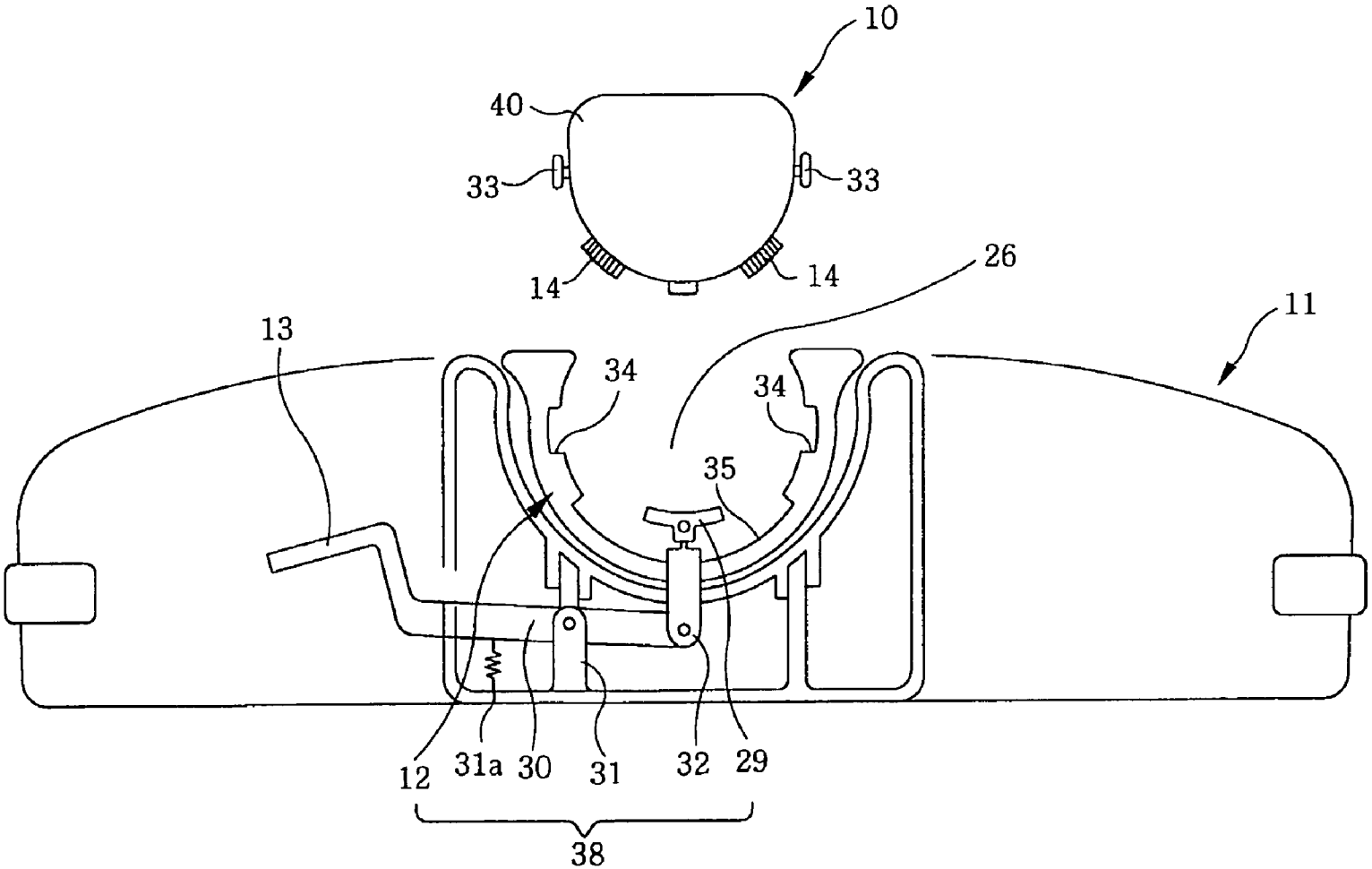
FIG. 5 presents a cross sectional view of the suction unit shown in FIG. 1 in a detached state thereof.
Figure 6:
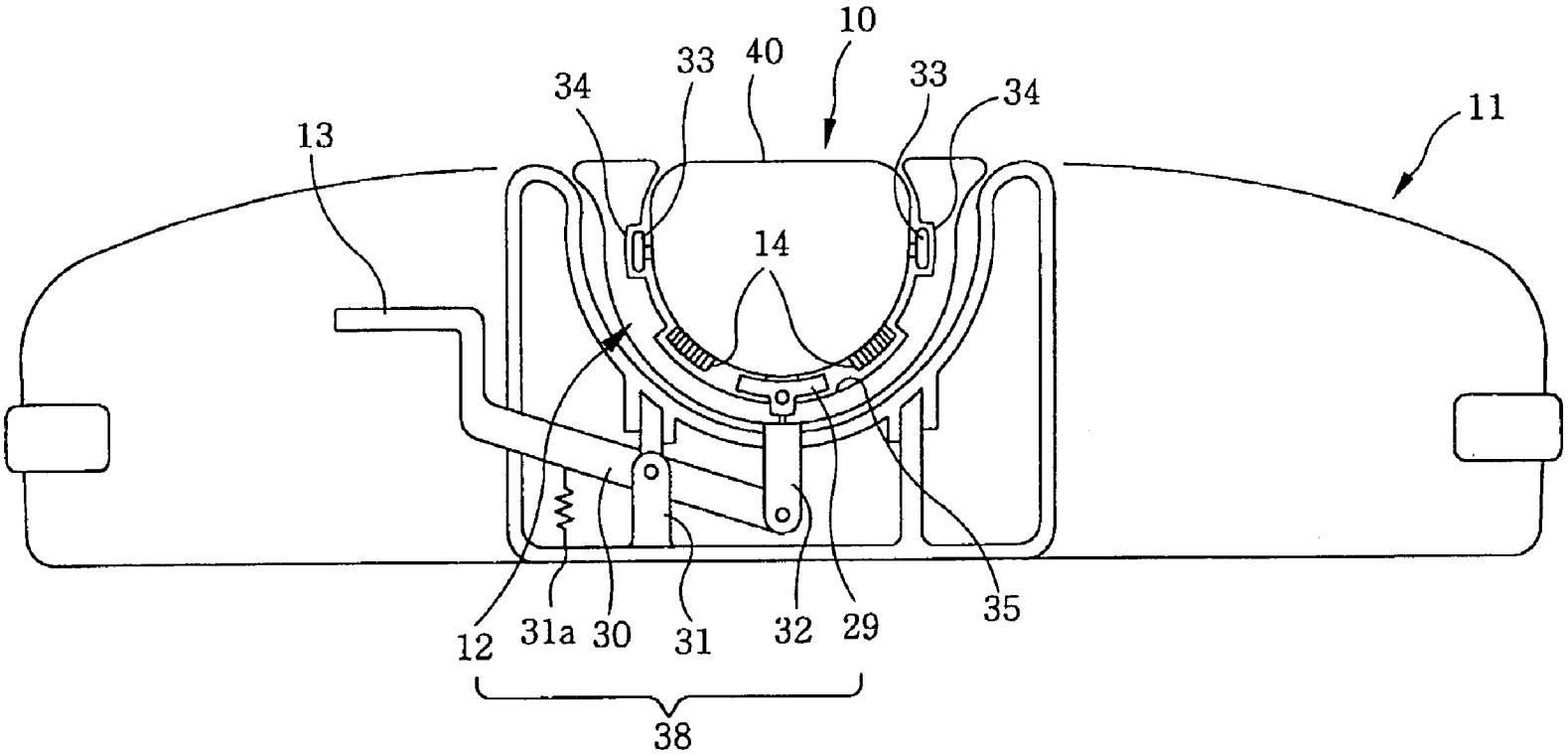
FIG. 6 discloses a cross sectional view of the suction unit shown in FIG. 1 in an attached state thereof.

Referring to FIGS. 5 and 6, there is shown support 12 (a means for disengaging and engaging the mini nozzle) disposed in nozzle accommodating recess 26 provided in floor nozzle 11, corresponding to a cross sectional shape of nozzle accommodating recess 26. Support 12 has a pair of supporting pieces which are respectively disposed to the left and the right of the hinge portion at approximately a center of support 12 and are engaged with each other at the hinge portion. There are shown in FIGS. 5 and 6, states in which support 12 is disengaged from and secured to floor nozzle 11, respectively. Specifically, mini nozzle 10 can be disengaged by pressing down on release lever 13, resulting in the disengaged state as shown in FIG. 5 and mini nozzle 10 can be engaged with floor nozzle 11 by inserting mini nozzle 10 into support 12, resulting in the secured state as shown in FIG. 6.

Under the disengaged state as shown in FIG. 5, support 12 extends from the hinge portion of the center thereof to the left and the right of the hinge portion. Upon inserting mini nozzle 10 into support 12, pressing member 29 placed at the center of the hinge portion is pressed and lowered such that support 12 is lowered to a bottom surface of nozzle accommodating recess 26 and as illustrated in FIG. 6 suction head 40 of mini nozzle 10 is surrounded and secured thereby. When pressing member 29 is lowered, driving member 32 connected thereto pushes down on one end of rod 30 supported by a pin joint at supporting member 31, and as a result release lever 13 placed on the other end of rod 30 is brought to an up position as illustrated in FIG. 6. Pressing member 29, rod 30, supporting member 31, driving member 32, and support 12 make up mini nozzle disengaging and engaging unit 38. Release lever 13 is always biased upward with respect to rotating joints of supporting member 31 by a resilient member (e.g., a spring) 31*a*.

There are provided outwardly biased engaging pins 33 on both sides of mini nozzle 10 to effectively secure mini nozzle 10 onto support 12 and corresponding thereto engaging recesses 34 for accommodating engaging pins 33 are provided in support 12, so that when mini nozzle 10 is inserted into support 12, engaging pins 33 are secured in engaging recesses 34, and thereby providing a more stable engagement of mini nozzle 10 to floor nozzle 11. Furthermore, there is provided raised fabric accommodating recess 35 for hosting raised fabrics 14 provided on mini nozzle 10, to prevent raised fabrics 14 from being deformed while being in the secured state of mini nozzle 10 and potentially losing its effectiveness.

In order to release mini nozzle 10 from floor nozzle 11 in the secured state as illustrated in FIG. 6, release lever 13 in the up position is pressed down, which rotates rod 30 about supporting member 31 and raises the hinge portion of support 12 via driving member 32. As a result, support 12 opens up and mini nozzle 10 is raised by pressing member 29, thereby enabling disengagement of mini nozzle 10 from floor nozzle 11.

Rotatable joint 8 rotatably connected to enable a vertical and horizontal rotation is provided between suction head 40 of mini nozzle 10 and connection tube 9 in mini nozzle 10 as described above. When mini nozzle 10 is engaged in floor nozzle 11 as illustrated in FIG. 2, connection tube 9 engages in a vertical motion corresponding to the motion of handle 4 connected with connection tube 9 via extension tube 2. A rotation of handle 4, that is handle 4 is manipulated so that floor nozzle 11 changes position in a horizontal direction, combined with rotatable joint 8 provided in a rear portion of floor nozzle 11 enables a smooth change in travel path of floor nozzle 11. In other words, the rotational motion exerted on rotatable joint 8 which rotates floor nozzle 11 in the horizontal direction results in smoothly changing the travel path of floor nozzle 11.

However, when using mini nozzle 10 disengaged from floor nozzle 11, there is a difficulty in manipulating the mini nozzle if it rotates in the horizontal direction. Under such case a rotation lock mechanism (not shown) preventing rotatable joint 8 from engaging in a movement in the direction of rotation of the mini nozzle 10 may be installed. Such rotation lock mechanism is provided with a stopper (not shown) biased by a spring, such that when mini nozzle 10 is engaged in floor nozzle 11, the lock release mechanism (not shown) provided on floor nozzle 11 which resists the bias of the spring releases the stopper from the rotation lock state. Under such configuration, when mini nozzle 10 is engaged in floor nozzle 11, the rotation lock is released, enabling a vertical and horizontal rotation of floor nozzle 11, however, such rotation is restricted when mini nozzle 10 is disengaged from floor nozzle 11.

Figure 7:
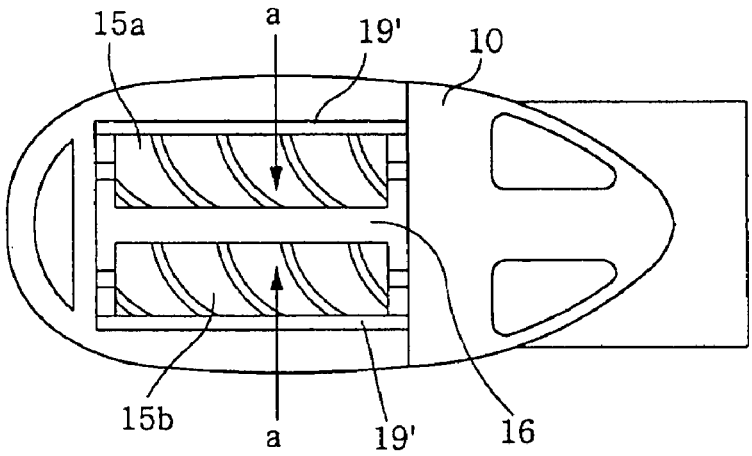
FIG. 7 offers a bottom view of a mini nozzle of the suction unit shown in FIG. 1.
Figure 8:
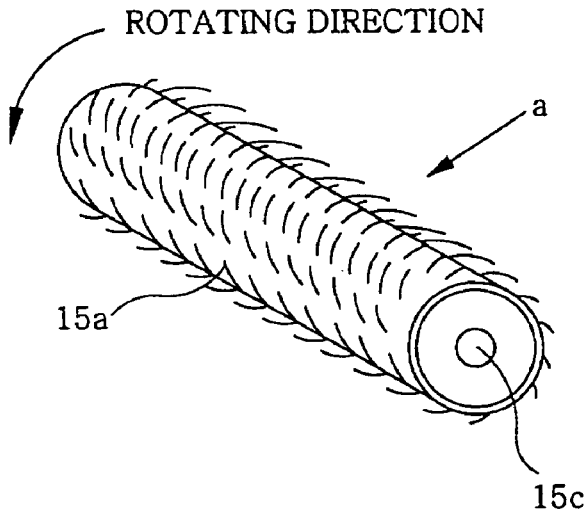
FIG. 8 depicts a perspective view of a rotor of the mini nozzle of the suction unit shown in FIG. 1.
Figure 9:
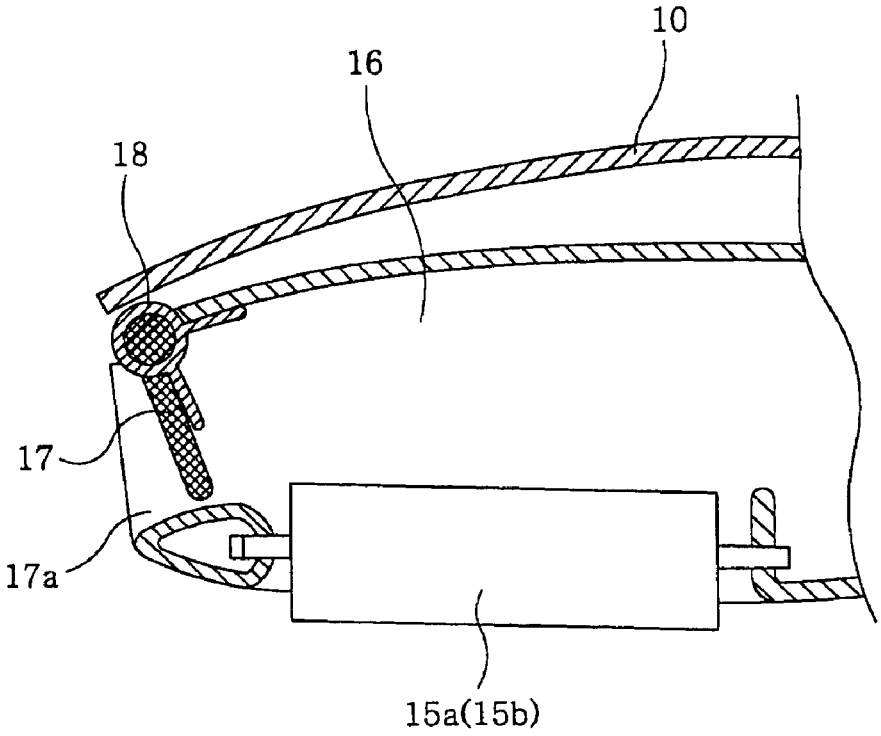
FIG. 9 is a partial side cross sectional view of the mini nozzle of the suction unit shown in FIG. 1.

Mini nozzle 10 as shown in FIG. 7 is rotatably provided with two rotors 15*a* and 15*b* at suction air intake chamber 16 including an opening for suctioning dirt particles thereinto, wherein rotors 15*a* and 15*b* are helically wound with the raised fabric in a form of cut fiber shape made of spun fabric of ultra fine fiber. Furthermore, there is provided ion generator 19' on a side wall of suction air intake chamber 16. In particular, the material of the raised fabric for rotors 15*a* and 15*b* are preferably those that have relatively greater positive charge affinity, e.g., nylon, wool, and the like. The raised fabric fiber that is helically wound on the outer periphery of rotors 15*a* and 15*b* is slanted to one direction, i.e., substantially perpendicular direction (opposite to the rotational direction) with respect to rotational shaft 15*c* as shown in FIG. 8. Moreover, as shown in FIG. 9, airflow controlling valve 17 to provide opening and closing of opening 17 is provided at a front portion of mini nozzle 10 by being axially supported at one distal end thereof and is maintained by a resilient member, e.g., a spring 18.

In the present embodiment two rotors are employed, however the number of such rotors may be tailored to meet the nature of the application. A single or more than two rotors may satisfactorily perform such tasks as brushing and wiping which are to be described below.

Hereinafter, an operation of the above-described configuration will be described.

When mini nozzle 10 is engaged in floor nozzle 11 of electric vacuum cleaner 1 employing such configuration of suction unit 3 described above, rotation brush 20 of wide floor nozzle 11 rotates and brushes against ion generator 19, and ion generator 19 is then negatively charged and emits negative charges. Thus emitted negative charges are attracted to the dirt particles present on the surface to be cleaned and are attracted toward the suction air stream and the brush that are positively charged. As a result, the dirt particles present on the surface to be cleaned is effectively removed therefrom. When mini nozzle 10 is engaged in floor nozzle 11, the rotors 15*a* and 15*b* are stopped and thus no negative charges are emitted from mini nozzle 10.

In case of cleaning a narrow space, e.g., stairway, that is inaccessible with floor nozzle 11, release lever 13 can be stepped on, without the user having to bend down to disengage mini nozzle 10 from floor nozzle 11, to thereby enable a vacuum cleaning with mini nozzle 10. The user is relieved from the inconvenience of having to manipulate the nozzles. Moreover, floor nozzle 11 which is disengaged from mini nozzle 10 is placed on the surface to be cleaned. Accordingly, the user may simply insert mini nozzle 10 into floor nozzle 11 to switch to vacuuming the floor.

When mini nozzle 10 is disengaged with floor nozzle 11 and is used by itself, suction air stream "a" flows toward suction air intake chamber 16, during which suction air stream "a" collides against the raised fabric of rotors 15*a* and 15*b* which results in a rotation of rotors 15*a* and 15*b*. Similar to the case of floor nozzle 11, by rotating rotors 15*a* and 15*b* in mini nozzle 10, the raised fabric brushes ion generator 19' and causes friction therebetween. As a result ion generator 19' becomes negatively charged and emits negative charges. Thus emitted negative charges are attracted to the dust particles present on the surface to be cleaned and are then attracted toward the suction air stream and the raised fabric having positive charge. As a result, the dust particles on the surface to be cleaned can effectively be eliminated. Although in the present embodiment rotors 15*a* and 15*b* are rotated by a suction air stream "a" entering suction air intake chamber 16 through a gap between the surface to be cleaned and a bottom surface of mini nozzle 10, an opening may be provided on a lateral side of suction unit 3, through which a suction air stream "a" can enter suction air intake chamber 16 and rotate rotors 15*a* and 15*b* thereby.

Moreover, a fiber of a raised fabric wound around an outer periphery of rotors 15*a* and 15*b* are slantingly disposed to be substantially perpendicular (opposite to the direction of rotation) to rotational shaft 15*c*. The suction air stream "a" initially collides with a distal end of the raised fabric of rotor 15*a* and 15*b*. The slantingly disposed fiber is dragged by the suction air stream "a" and provides powerful rotation. It is preferable that the suction air stream "a" is entered at an angle of 45 degrees to the left and the right with respect to the distal end of the raised fabric.

Furthermore, airflow controlling valve 17 is pushed by the suction air stream at opening 17*a*, and a front portion of suction air intake chamber 16 is opened until a static equilibrium is reached with a force exerted by spring 18. Accordingly, when the suction air stream is large, suction air intake chamber 16 is made substantially open for the purpose of noise reduction by reducing the number of rotation of rotors 15*a* and 15*b*. Further, when the suction air stream "a" is small suction air intake chamber 16 is substantially sealed to increase the number of rotation of rotors 15*a* and 15*b*, to thereby improve wiping, brushing, and polishing capabilities thereof. When mini nozzle 10 is engaged in floor nozzle 11, airflow controlling valve 17 is opened to thereby form an air communication throughout the entire unit.

Although, a canister type electric vacuum cleaner is chosen as an example in the present embodiment, the configuration of suction unit 3 of the present embodiment may be applicable to a hand vacuum cleaner having a short suction path in a main body thereof having a handle thereon, thereby enhancing capability thereof.

Under such configuration of the present embodiment, since rotors 15*a* and 15*b* having raised fabric wound around an outer periphery thereof is rotatable solely by means of the suction air stream, a mechanical means, e.g., a motor, is unnecessary. Further, such configuration can provide light, compact and low cost wiping, polishing, and brushing capabilities of high efficiency.

Moreover, by powering the rotation of the rotors merely with direct contact of the suction air stream with the raised fabric fiber, parts other than those in the arrangement of the raised fabric are not needed, which in turn greatly simplifies the design, improves the reliability thereof and reduces the cost of a suction unit.

Moreover, the slanting of the raised fabric fiber in a substantially perpendicular direction (opposite to the direction of rotation) with respect to the rotating axis, which facilitates dragging thereof by the suction air stream and yields greater rotation, provides a suction unit with highly effective wiping, brushing, polishing capabilities.

Furthermore, the slanting of the raised fabric fiber in one direction [substantially perpendicular direction with respect to the rotating axis (opposite to the direction of rotation)] only raises fiber when in contact with the suction air stream, which yields greater drag thereof like a wind mill, and as a result a greater rotation is obtained, which in turn provides the suction unit with highly effective wiping, brushing, polishing capabilities.

The helically wound raised fabric on the outer periphery of the rotors, increases drag thereof due to a colliding of suction air stream against adjoined portions of the raised fabric, and as a result a suction unit having highly effective capabilities of wiping, brushing, and polishing.

Embodiment II

A second preferred embodiment in accordance with the present invention will now be described with reference to FIGS. 10 and 11. Parts that are substantially identical to those shown above will be assigned with the same reference numerals and the description thereof will be omitted.

Figure 10A:
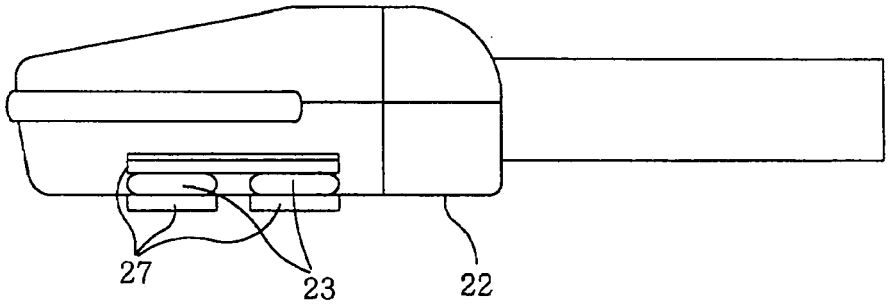
FIGS. 10A, 10B and 10C are a side elevational view of a mini nozzle of a suction unit for use in electric vacuum cleaners in accordance with a second embodiment of the present invention, a bottom view of the suction unit shown in FIG. 10A, and a front view of the suction unit shown in FIG. 10A respectively.
Figure 10B:
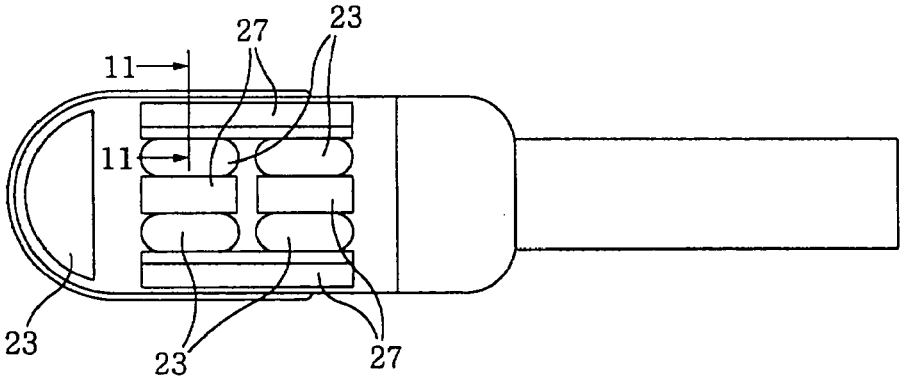
Figure 10C:
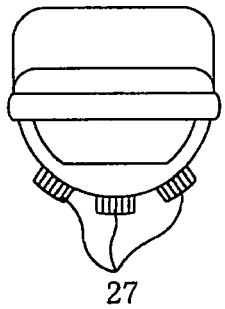
Figure 11:
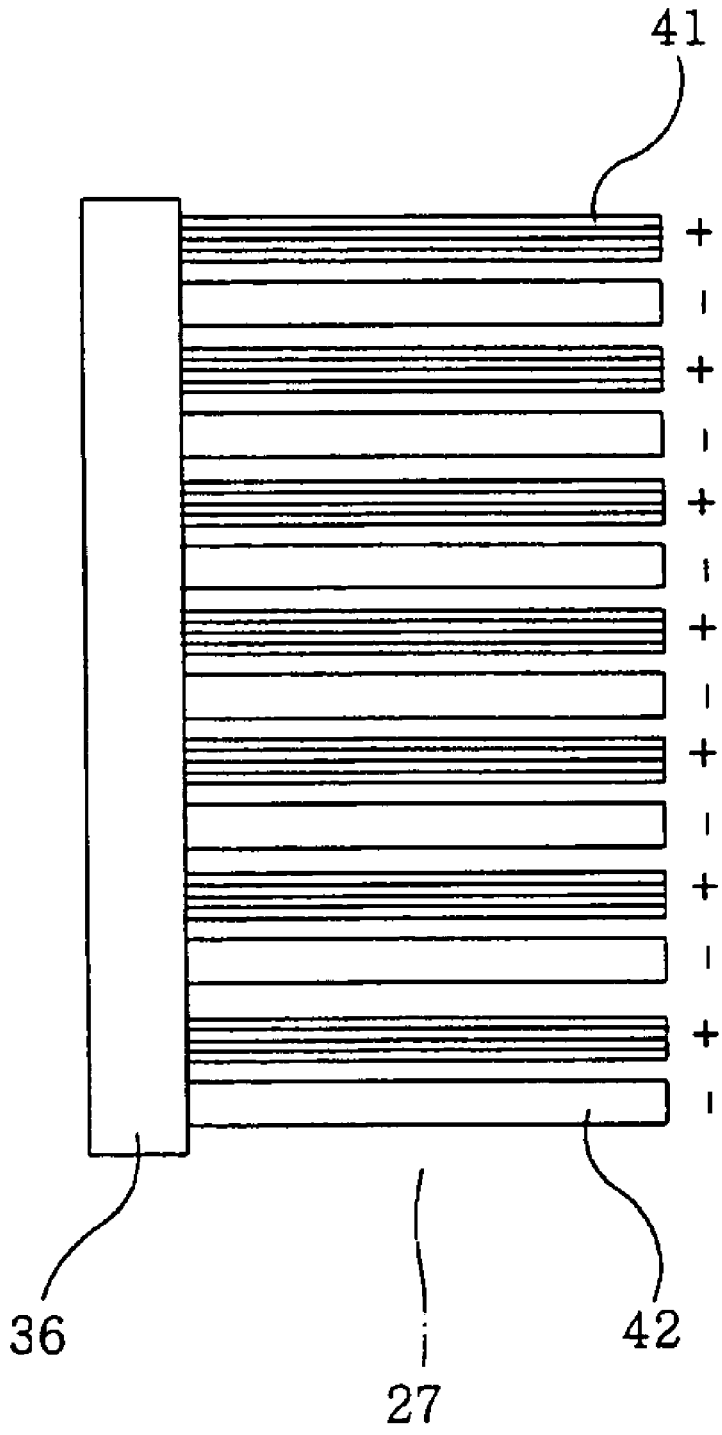
FIG. 11 provides an enlarged cross sectional view of the suction unit taken along the line 11-11 in FIG. 10B.

A portion from lower side faces of mini nozzle 10 to bottom 22 is formed in an arc shape and is provided with a plurality of openings 23 as shown in FIG. 10. At a bottom-most peak portion along the axis bristles 27 made up of bristle members having different relative charge affinity as shown in FIG. 11 is provided on a sheet of base fabric 36 and there are provided openings 23 at both lateral sides thereof, having bristles 27 at respective sides thereof.

Hereinafter, an operation of the above-described configuration will be described.

When vacuum cleaning, bristles 27 come in contact with a surface to be cleaned, creating a friction therebetween, at which time bristle members 41 and 42 from positive items in the triboelectric series and negative items therein, respectively, are brushed against each other, creating a friction therebetween and as a result bristle member 42 from negative items in the series becomes negatively charged and emits negative charges. The single sheet of base fabric 36 is a ground fabric, which acts as a ground to the charged bristle members. Such negative charge emitting bristle member 42 comes in contact with the surface to be cleaned and emits negative ions to be efficiently attracted to the dirt particles on the surface to be cleaned. By forming the bottom surface of the mini nozzle in a shape of an arc, perpendicularly configured surfaces, e.g., steps, can be in a contact with the bristles 27, and as a result the negative ion effect can be enhanced. In addition, under such configuration, dust particles in crevices or recesses can be collected. Furthermore, by providing a plurality of the opening 23, the dirt particles can be effectively suctioned and eliminated. Furthermore, bristles having bristle members of different relative charge affinity can be formed at a low cost.

In accordance with the present invention as described above, by the floor nozzle, mini nozzle, and the ion generator provided therein dirt particles on a surface to be cleaned can be effectively removed while having a mini nozzle engaged in a floor nozzle. Even in a small space normally difficult to be cleaned with the floor nozzle can be effectively cleaned with ions by only using the mini nozzle.

While the invention has been shown and described with respect to the preferred embodiments, it will be understood by those skilled in the art that various changes and modifications may be made without departing from the spirit and scope of the invention as defined in the following claims.

What is claimed is:

1. A suction unit for use in an electric vacuum cleaner, comprising:

a floor nozzle; and a mini nozzle detachably secured to the floor nozzle, wherein when a section head of the mini nozzle is secured to the floor nozzle, an air communication is provided therebetween, and wherein the mini nozzle includes an ion generating unit and a suction air intake chamber provided with an opening for suctioning dirt particles thereinto, wherein the ion generating unit includes at least one rotor provided in the suction air intake chamber, said at least one rotor having a surface made of raised fabric and being rotated by an air stream flowing into or in the suction air intake chamber; and a generator installed in the suction air intake chamber, the generator being made of material having relative charge affinity different from that of the raised fabric and coming into frictional contact with the raised fabric to generate ions.

2. The suction unit of claim 1, wherein the floor nozzle includes another ion generating unit.

3. The suction unit of claim 1, wherein a fiber of the raised fabric is slanted and the air stream comes into contact therewith via distal ends thereof.

4. The suction unit of claim 3, wherein the fiber of the raised fabric is provided substantially perpendicular with respect to a rotational axis of the rotor.

5. The suction unit of claim 1, wherein the raised fabric is made of material that has a relatively greater positive charge affinity and the generator is made of material that has a relatively greater negative charge affinity.

6. An electric vacuum cleaner comprising:

an electric blower generating suction air stream; and the suction unit recited in claim 1 communicating with the electric blower.

7. A suction unit for use in an electric vacuum cleaner, comprising:

a floor nozzle;

a mini nozzle detachably secured to the floor nozzle, wherein when a section head of the mini nozzle is secured to the floor nozzle, an air communication is provided therebetween, and wherein the mini nozzle includes an ion generating unit;

a suction air intake chamber installed at the mini nozzle and provided with an opening for suctioning dirt particles thereinto; and bristles provided within or near the suction air intake chamber, the bristles having bristle members of different relative charge affinity, wherein when the bristles move on a surface to be cleaned, the bristle members come into a frictional contact with each other to generate ions.

8. The suction unit of claim 7, wherein the bristle members are installed at a single sheet, the single sheet being a ground fabric.

9. An electric vacuum cleaner comprising:

an electric blower generating suction air stream; and the suction unit recited in claim 7 communicating with the electric blower.

* * * * *